US008123583B2

(12) United States Patent
Hitzschke et al.

(10) Patent No.: US 8,123,583 B2
(45) Date of Patent: Feb. 28, 2012

(54) PRODUCTION METHOD FOR DISCHARGE LAMPS

(75) Inventors: Lothar Hitzschke, München (DE); Frank Vollkommer, Gauting (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 12/452,603

(22) PCT Filed: Aug. 1, 2007

(86) PCT No.: PCT/EP2007/057935

§ 371 (c)(1), (2), (4) Date: Jan. 11, 2010

(87) PCT Pub. No.: WO2009/015694

PCT Pub. Date: Feb. 5, 2009

(65) Prior Publication Data

US 2010/0159780 A1 Jun. 24, 2010

(51) Int. Cl.

| | |
|---|---|
| ***H01J 9/38*** | (2006.01) |
| ***H01J 9/385*** | (2006.01) |
| ***H01J 9/395*** | (2006.01) |

(52) U.S. Cl. ..... 445/53; 445/38; 445/41; 445/42

(58) Field of Classification Search ..... 445/16, 445/22–27, 38–43, 53–57

See application file for complete search history.

(56) References Cited

U.S. PATENT DOCUMENTS

| | | | | |
|---|---|---|---|---|
| 4,578,043 | A * | 3/1986 | Teshima et al. | 445/40 |
| 5,114,372 | A | 5/1992 | Fuchs | |
| 6,172,460 | B1 * | 1/2001 | Damen et al. | 445/41 |
| 6,659,828 | B1 * | 12/2003 | Seibold et al. | 445/40 |
| 2003/0060116 | A1 | 3/2003 | Hitzschke et al. | |

FOREIGN PATENT DOCUMENTS

| | | | |
|---|---|---|---|
| DE | 101 47 727 | A1 | 9/2001 |
| DE | 102 25 612 | A1 | 6/2002 |
| JP | 09199033 | A | 7/1997 |

* cited by examiner

*Primary Examiner* — Mariceli Santiago

(74) *Attorney, Agent, or Firm* — Holtz Holtz Goodman & Chick PC

(57) ABSTRACT

The present invention relates to a method for producing a discharge lamp using a two-stage filling process.

7 Claims, 2 Drawing Sheets

PRODUCTION METHOD FOR DISCHARGE LAMPS

This application is a U.S. National Phase Application under 35 USC 371 of International Application PCT/EP2007/057935, filed Aug. 1, 2007, which is incorporated herein in its entirety by this reference.

TECHNICAL FIELD

The present invention relates to a method for producing a discharge lamp.

PRIOR ART

Discharge lamps have a closed discharge vessel containing a discharge gas. Accordingly, a method for producing discharge lamps comprises introduction of the discharge gas and sealing of the discharge vessel.

It is known to assemble and seal discharge vessel parts in a vacuum furnace under a discharge gas atmosphere. Before the discharge gas atmosphere is formed, the vacuum furnace enclosing the discharge vessel parts is evacuated in order to remove undesired gases from the furnace and adsorbates from the discharge vessel parts.

It is furthermore known to pump out discharge vessels with a pumping tube and then fill them with a discharge gas. After the filling, the pumping tubes are conventionally sealed by fusing; optionally, protruding parts are removed.

DE 101 47 727 A1 discloses a continuous furnace for assembling discharge vessel parts and filling the assembled discharge vessels. In this case, the discharge vessel parts are introduced into an atmosphere of the discharge gas and assembled in this atmosphere, while also being sealed.

DE 102 25 612 A1 discloses a chamber for assembling and sealing discharge vessel parts. The chamber surrounding the discharge vessel parts is flooded with the discharge gas under a moderate positive pressure, so that the discharge gas flushes around the discharge vessel parts.

SUMMARY OF THE INVENTION

It is an object of the invention to provide a method for producing a discharge lamp, which is advantageous in respect of filling and closing the discharge vessel.

The invention relates to a method for producing a discharge lamp, having the steps: assembling an open discharge vessel of the discharge lamp and filling it with a first gas in an environment of the first gas, characterized by the subsequent step: adding a second gas to the first gas in the assembled discharge vessel, using a supply volume separate from the outer environment of the discharge vessel.

Preferred configurations are the subject-matter of the dependent claims and will likewise be explained in more detail below.

The invention is based on the idea that pumping out and filling a discharge vessel through a pumping tube entails great outlay: a certain time is required for pumping out, in order to achieve the desired purity it is necessary to use a considerable pumping power, and corresponding systems are complicated and therefore expensive. Specifically with large discharge vessels, for instance those for flat radiators with a large diagonal, owing to the large internal surface of the discharge vessel (on which adsorbates can adhere), it is difficult to ensure the desired purity. Furthermore, some discharge lamps break during pumping.

The invention is furthermore motivated by the concept that the assembly, i.e. connection, of discharge vessel parts and the filling of discharge vessels with a gas can be carried out simultaneously.

Lastly, the invention is based on the discovery that in the case of discharge vessels which are correspondingly filled and closed in a discharge gas atmosphere, for instance by assembling discharge lamp parts under a neon/xenon atmosphere in a continuous furnace, part of the discharge gas typically escapes into the environment and is thus lost. On the one hand this is economically detrimental since some of the gases typically used for discharge gases, for instance xenon, contribute significantly to the costs of the production method. Furthermore, the discharge gas may comprise components whose escape into the environment should be avoided for other reasons, for instance in the case of chemically very reactive, environmentally harmful and/or toxic gases. Collecting the gas not introduced into the discharge vessel and recycling it requires additional equipment outlay, which may be considerable.

As mentioned, the discharge gas typically comprises a plurality of components, for instance helium, neon, argon and xenon. The idea of the invention is now to divide the components finally desired for the discharge gas into a first gas and a second gas, and initially to fill an open discharge vessel in an environment of the first gas. The discharge gas is finally completed by introducing the second gas into the discharge vessel in a controlled way, after the discharge vessel has been assembled and at least partially closed.

For the second filling step, a supply volume is used which is separated from the environment of the discharge vessel, i.e. it does not on its own form the environment. Exchange of the interior of the discharge vessel with the entire environment of the discharge vessel is not used here, but instead the second gas is limited to a particular volume and therefore introduced in a controlled way. Here, the environment is thus intended to mean the outer environment of the discharge vessel, but not the discharge space in it. It is feasible, each case being dealt with in further detail, both to supply through a line for the second gas and to connect the line to a corresponding filling opening of the discharge vessel, and also to fit a separate volume filled with the second gas in the discharge vessel for subsequent mixing of the two gases by opening this volume after complete sealing of the discharge vessel. In the first case, the supply volume is outside the discharge vessel, but only a small part of its environment and separated from the rest of the environment. In the second case, it lies in the discharge vessel and is therefore already separated from the outer environment by a further boundary. What is important in both cases is that the second gas is introduced in a controlled way and not in excessive amounts, i.e. while preventing it from spreading into the environment.

Although the discharge vessel is preferably sealed entirely hermetically by the assembly after the first filling step, this is not necessarily the case. For instance, a comparatively small hole could remain in the discharge vessel wall after closure, the second gas being introduced through this hole. It may, however, also be re-opened for this purpose. As an alternative, the discharge vessel may be closed and already contain the separate volume of the second gas.

Overall, the invention therefore avoids a step of filling with the second gas in the entire environment of the discharge vessel, for instance in a continuous furnace.

It is correspondingly advantageous to add the comparatively favorable or chemically unproblematic components of the discharge vessel to the first gas—and the other components to the second gas.

Since any loss or spreading of the second gas can be kept small, or even prevented, possibly elaborate recovery of components of the second gas may possibly also be obviated.

The invention thus allows controlled introduction of particular discharge gas components with the second gas. According to the invention, the second gas and the first gas should therefore be different, and in particular the components for which filling in or from an entire environment of the discharge vessel is favorable should fully or at least substantially be assigned to the first gas, and correspondingly other components for which controlled introduction is of particular advantage are predominantly assigned to the second gas. This may also be quantified with the aid of the partial pressure of the discharge gas components: it is preferable for the second gas to comprise a component whose partial pressure in the discharge gas is at least 70% due to the second gas, more preferably at least 90% or even 98%. In other words: the discharge gas should contain at least one component which is attributable essentially or virtually exclusively to the step of filling with the second gas.

The preferably comparatively large opening of the discharge vessel before assembly allows rapid filling of the discharge vessel with the first gas, or even flushing with it, particularly in the case of discharge vessel parts which are still separated. By such flushing of the discharge vessel with the first gas, it can be cleaned and further contaminants can furthermore be kept away—including those in the form of undesired gases. Elaborate evacuation of a chamber, such as in the case of a vacuum furnace, can be obviated here.

When discharge vessels are fully closed in a gas atmosphere, the partial pressures of the components of this gas in the discharge vessel depend on the temperature of the gas during closure. If manufacturing tolerances due to this are intended to be avoided for particular components of the discharge gas, then these components may be added to the second gas.

It is preferable to use a continuous furnace for the first filling step, while also using the first gas in a continuous furnace to clean the discharge vessel and to keep contaminants away. To this end, a flow of the first gas around the discharge vessel is established in the continuous furnace. Depending on the distribution of the discharge gas components between the first and second gases, recovery of the first gas may not need to be carried out—even with high throughputs.

Furthermore, continuous furnaces do not have to be heated constantly from a cooled state, as furnaces operating on a batch basis do, which is costly in terms of time and energy; this is particularly true in the case of large furnaces for large lamps.

The discharge gas may contain components which make analysis of the discharge gas by means of spectroscopy difficult, or even prevent it. Discharge gas components which are not intended to be co-analyzed may be introduced with the second gas into the discharge vessel. In one configuration, a spectral analysis of the first gas in the discharge vessel is therefore carried out after at least partially closing the discharge vessel and before introducing the second gas. In this context, for example, in the case of a xenon/neon mixture the xenon could be introduced by means of the second gas. Like other light noble gases, neon has a substantially higher excitation energy than xenon so that contaminants can be detected by spectroscopy of the discharge radiation. Owing to its relatively low excitation energy, xenon would generally interfere with this.

Such a spectroscopic examination may for example be carried out by igniting a local discharge with the aid of auxiliary electrodes outside the furnace, for instance simple metal strips, after the first filling step. The auxiliary electrodes may then be removed so that they do not interfere with the rest of the production process and are not present on the finished lamp.

In one possible embodiment, the second gas is introduced into the discharge vessel through a filling spout. For example, the filling spout may already be applied on a discharge vessel part before closing the discharge vessel, and preferably also sealed before as well as after this step. As an alternative, however, a spout may also be placed on a hole of the discharge vessel remaining after closure and the second gas may be introduced through it. Subsequently, this spout may for instance be fused with the discharge vessel. The filling spout may then be opened before the second filling step, for example by fracturing it.

In another particular embodiment of the invention, an ampoule of the second gas may be enclosed in the discharge vessel during the first filling step and the assembly, and subsequently opened. In this way, the amount of second gas introduced into the discharge vessel can be controlled accurately.

The ampoule may for example be fractured with the aid of a laser or other electromagnetic waves. Once it has been opened, the second gas mixes with the first gas in order to form the discharge gas.

It is preferable for the ampoule to be held on the edge of the discharge vessel. If the ampoule lies outside the luminous field, it will not interfere with the light delivered by the discharge lamp. Furthermore, particularly on the edge of the discharge vessel, the ampoule can be held so that it does not spatially restrict the discharge. Preferably, uncoated discharge vessel windows, particularly openings in the layer of luminescent material, are provided in the same region or next to the holder for the ampoule in order to be able to carry out the aforementioned diagnostics.

In principle, the first gas could be subject to a recovery process. However, the two-stage process according to this invention specifically makes it possible to carry out the filling process for gases as a second step such that the first gas can advantageously be disposed of more simply.

The invention relates in particular to the production of so-called flat radiators, in which the discharge vessel is configured to be flat and have a relatively large format in relation to its thickness. Conventionally, the long sides of the flat radiator are formed by two essentially plane-parallel plates. The plates may be structured and, despite the name "flat radiator", need not be flat in the strict sense of the word.

The invention furthermore relates in particular to the production of dielectric barrier discharge lamps. Here, the power for sustaining the discharge is input capacitively into the discharge gas through electrodes dielectrically separated from the discharge gas.

BRIEF DESCRIPTION OF THE DRAWINGS

The invention will be explained in more detail below with the aid of exemplary embodiments. Individual disclosed features may also be essential to the invention in combinations other than those shown.

In the figures.

PREFERRED EMBODIMENT OF THE INVENTION

Figure 1:
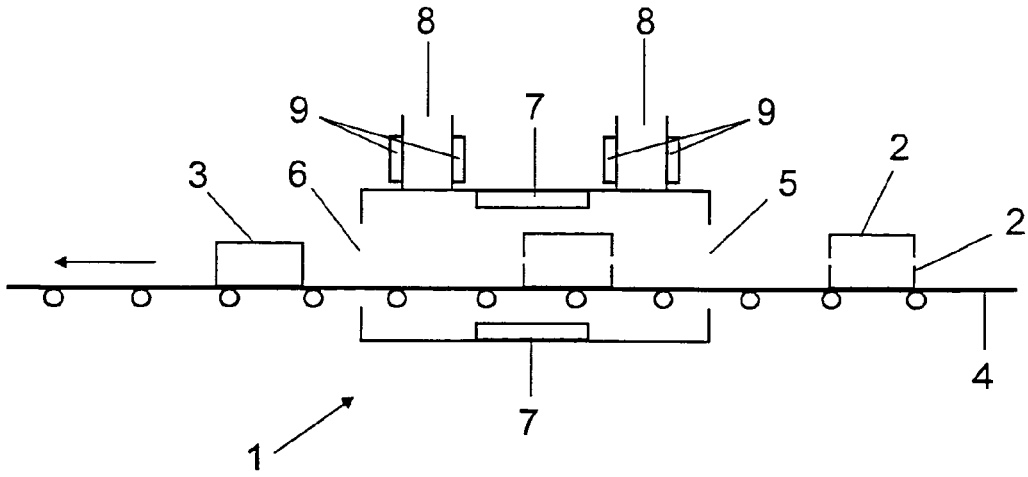
FIG. 1 shows a continuous furnace for carrying out the method according to the invention.

FIG. 1 shows a continuous furnace 1 for assembling discharge vessel parts 2 to form discharge vessels 3. The discharge vessel parts 2 are introduced into the continuous furnace 1 from right to left in the drawing on a conveyor belt 4 through an opening 5 of the furnace, and the assembled discharge vessels 3 are transported out of the furnace 1 through an opening 6.

The discharge vessel parts 2 correspond to a top (above) and bottom (below) of the finished discharge vessel 3. The discharge vessels 3 are intended for dielectric barrier flat radiators. The outer-lying electrodes, or their contacts, are applied in a manner known per se in subsequent method steps (not shown).

Before they are introduced into the furnace 1, cleaning and processing steps known per se (not shown) are already carried out on the discharge vessel parts 2; for instance, the inner sides of the discharge vessel parts are coated beforehand with a luminescent material and partially a reflector layer.

The continuous furnace 1 comprises heating elements 7 for heating the furnace interior. Gas feeds 8 are provided with further heating elements 9. The furnace interior is heated by the heating elements 7 and by a first gas, which is introduced through the gas feeds 8 and is heated by the heating elements 9.

In order to assemble the initially still separated discharge vessel parts 2, $SF_6$ glass pieces are placed between them as spacers. Owing to the high temperature in the continuous furnace 1, these soften and the upper discharge vessel part 2 is lowered onto the lower discharge vessel part 2. The edges of the discharge vessel parts 2 are provided with a glass solder, which is melted in the continuous furnace 1 and by means of which the discharge vessel parts 2 are hermetically assembled with one another.

Before the actual filling, the discharge vessel parts or the assembled discharge vessels must be cleaned and flushed in a manner known per se, in order to remove residual moisture and possible residual constituents of organic materials such as solvents or binder constituents.

The furnace interior is flooded with the first gas, a helium/neon mixture, through the gas feeds 8. The helium/neon mixture is introduced with a pressure sufficient to ensure a constant flow through the furnace interior and the openings 5 and 6 of the continuous furnace. Other than the $SF_6$ glass pieces, only the first gas introduced through the gas feeds 8 lies between the initially still separated discharge vessel parts 2 inside the continuous furnace. As soon as the $SF_6$ glass pieces become soft, the first gas is enclosed when the upper discharge vessel part 2 is lowered onto the lower discharge vessel part 2.

Figure 2:
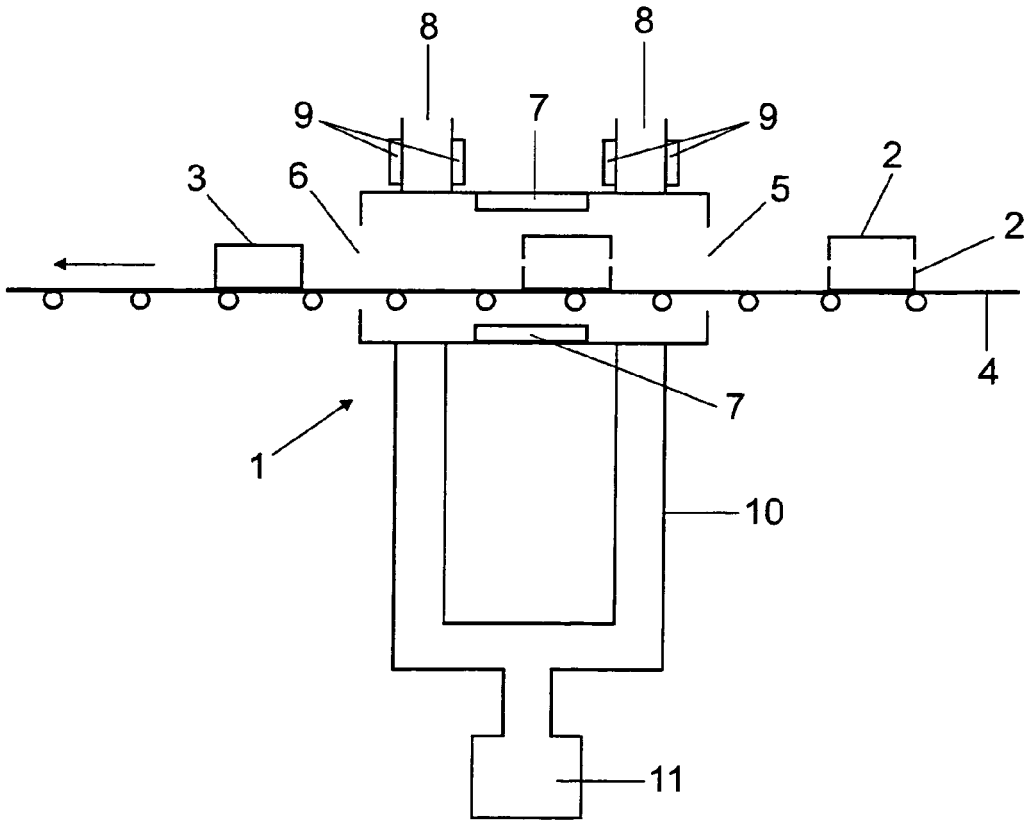
FIG. 2 shows the continuous furnace of FIG. 1 with enhancements.

FIG. 2 shows the continuous furnace of FIG. 1 supplemented with gas suction lines 10 and a pump 11. Here, the first gas flows primarily into the gas suction lines 10. The noble gases are sucked out then recovered in a manner known per se (not shown).

A production method using a continuous furnace, having a plurality of furnace chambers in which various working steps are carried out, is presented in more detail in DE 101 47 727 A1. For better understanding, reference is made thereto.

Figure 3:
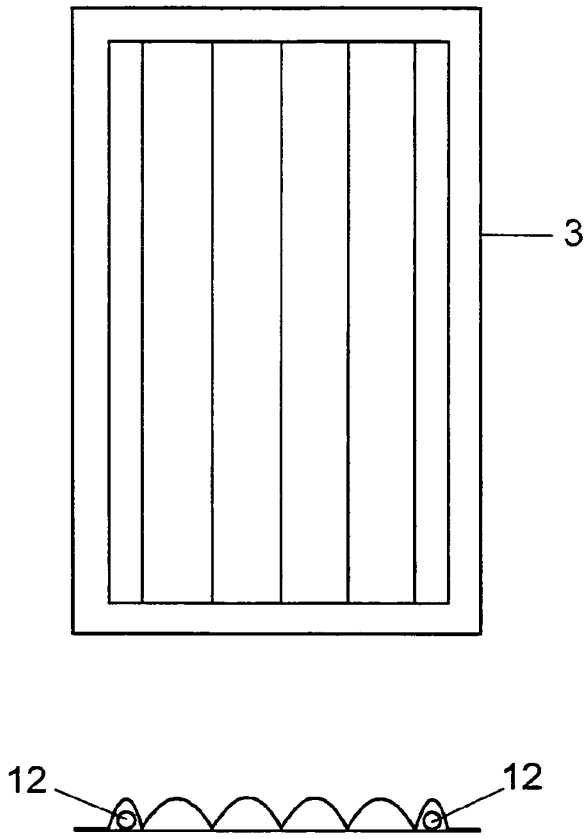
FIG. 3 shows a discharge vessel after some of the production method according to the invention has been carried out on it.

FIG. 3 shows from above one of the discharge vessels 3 assembled as just described. It hermetically encloses the He/Ne gas mixture; it furthermore contains ampoules 12 held on the outer edge, which are provided in the smaller lateral channels and are round in section. The ampoules themselves, and that inner side of the discharge vessel 3 along which they are held, are not—like the rest of the inner surface of the discharge vessel 3—coated with a luminescent material or a reflector layer. Between the two ampoule channels, FIG. 3 furthermore shows channels which are larger in cross section, form the actual discharge volume and have already been described elsewhere in the prior art.

An IR laser is preferably used to open the ampoules. Microwaves, for example, may also be used. In any event, energy input into subregions of the ampoules generates temperature gradients, which lead to fracture by material stresses. To this end the subregions, for instance the ampoule tips, are for example metal-coated.

The discharge vessel is 40 cm wide, 70 cm long and on average internally 0.3 cm high, but locally even up to 0.55 cm high (internal height). The ampoules have 1 mm thick quartz walls, are 67 cm long and have an internal diameter of 3 mm. A xenon pressure of 10 bar inside the ampoules 12 (at room temperature) gives a xenon partial pressure of 0.1 bar inside the discharge vessel 3 when the ampoules have been opened by laser irradiation and the xenon has been distributed into the discharge vessel 3 (at room temperature).

Before opening the ampoules, the emission spectrum of the He/Ne mixture is examined. Contaminants can thus be detected and the production of further defective discharge lamps can be avoided.

Figure 4:
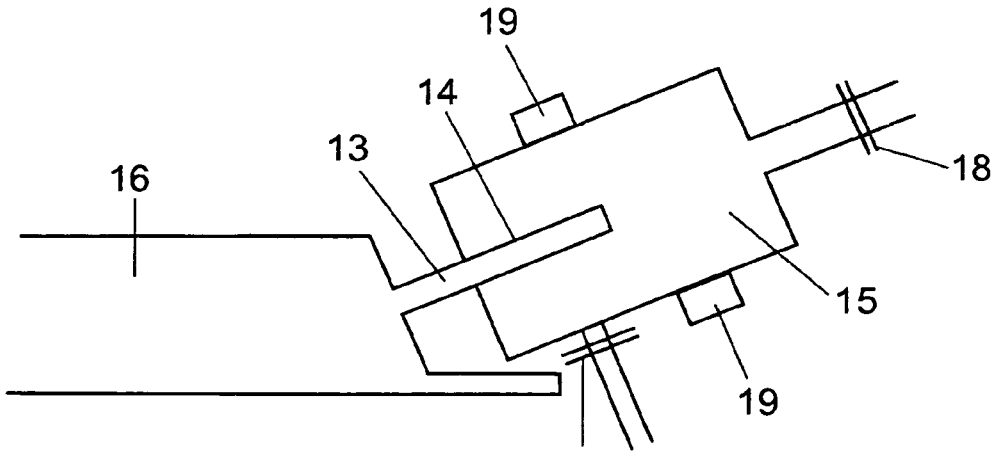
FIG. 4 shows a schematic representation for an alternative option to FIG. 3.

FIG. 4 outlines another variant of the second step of filling with a filling spout 13. The latter is introduced into a filling volume 15 by means of a gasket 14 and is sealed at its end arranged in this filling volume 15.

The other end of the filling spout 13 opens into the discharge vessel 16 schematically indicated on the left.

The filling volume 15 is connected by a first valve 17 to a gas outlet and by a second valve 18 to a gas inlet. It furthermore comprises a heater 19 as indicated. The filling volume 15 is a component of a further filling device, i.e. not a component of the continuous furnace, and encloses the filling spout 13 in the manner outlined here. The outer region of the filling spout 13 and the interior of the filling volume 15 are cleaned by a flushing step using the two valves 17, 18 and the gas inlet and outlet. Optionally, it may also be pumped out for cleaning purposes with the second valve closed and the first valve open.

The filling spout 13 is opened by a mechanical instrument, not shown (feed-through into the filling volume 15), or by IR laser or microwave irradiation onto a metal coating on its end in order to introduce a second gas, which has previously been introduced into the filling volume 15 through the gas inlet, into the interior of the discharge vessel. A gas pressure is in this case set up which automatically leads to the desired discharge gas mixture in the discharge vessel after opening the filling spout 13.

Once the second filling step has been completed, the filling spout 13 can be shortened and sealed by melting and removal with a flame in a manner generally known for so-called pump stems in lamp technology. It preferably consists of the same glass material as that which constitutes the top glass of the discharge vessel.

In the manner explained, a second filling step can be carried out as an alternative to the ampoule technique already described above with reference to FIG. 3. The first filling step of the two variants is the same.

The invention claimed is:

1. A method for producing a discharge lamp, having the steps:

assembling an open discharge vessel (2, 3, 16) of the discharge lamp and filling it with a first gas in an environment (1) of the first gas, adding a second gas to the first gas in the assembled discharge vessel (3), using a supply volume (12, 15) separate from the environment of the discharge vessel (3) and wherein the assembly and filing of the discharge vessel (2, 3, 16) with the first gas are carried out in a continuous furnace (1)

characterized in that a spectral analysis of the first gas in the discharge vessel (3, 16) is carried out after closing the discharge vessel (3, 16) and before introducing the second gas.

2. A method for producing a discharge lamp, having the steps:

assembling an open discharge vessel (2, 3, 16) of the discharge lamp and filling it with a first gas in an environment (1) of the first gas, adding a second gas to the first gas in the assembled discharge vessel (3), using a supply volume (12, 15) separate from the environment of the discharge vessel (3) and wherein the assembly and filing of the discharge vessel (2, 3, 16) with the first gas are carried out in a continuous furnace (1)

characterized in that the second gas is introduced into the discharge vessel (16) through a filling spout.

3. The method as claimed in claim 1 or claim 2, characterized in that the first gas flows around the discharge vessel (2, 3).

4. The method as claimed in claim 1 or claim 2, characterized in that the discharge vessel (2, 3) is fully closed after filling with the first gas and contains an ampoule (12) of the second gas, the ampoule (12) subsequently being opened.

5. The method as claimed in claim 4, characterized in that the ampoule (12) is opened by electromagnetic waves.

6. The method as claimed in claim 4, characterized in that the ampoule (12) is held on the edge of the discharge vessel (2, 3).

7. The method as claimed in claim 1 or claim 2, characterized in that the discharge lamp is a flat radiator.

* * * * *